United States Patent [19]

Tanigawa et al.

[11] Patent Number: 4,877,409

[45] Date of Patent: Oct. 31, 1989

[54] HINGED ELECTRICAL CONNECTOR

[75] Inventors: Junichi Tanigawa, Kawasaki; Shoji Kikuchi, Hiratsuka, both of Japan

[73] Assignee: AMP Incorporated, Harrisburg, Pa.

[21] Appl. No.: 281,435

[22] Filed: Dec. 8, 1988

[30] Foreign Application Priority Data

Jan. 22, 1988 [JP] Japan ..... 63-12425

[51] Int. Cl.[4] ..... H01R 13/193; H01R 23/70

[52] U.S. Cl. ..... 439/31; 439/857; 439/65

[58] Field of Search ..... 439/629–637, 439/61, 62, 856, 857, 31, 65

[56] References Cited

U.S. PATENT DOCUMENTS 3,289,146 11/1966 Tuchel ..... 439/630
3,601,746 8/1971 Teagno .
4,341,430 7/1982 Crawford .
4,632,475 12/1986 Tomita .
4,657,320 4/1987 Bamford et al. .

*Primary Examiner*—Gary F. Paumen
*Attorney, Agent, or Firm*—Adrian J. LaRue; Bruce J. Wolstoncroft

[57] ABSTRACT

A hinged electrical connector comprises connector members (1, 2) mounted onto circuit boards (11*a*, 11*a*) and hingedly connected together by shafts (4) and recesses (6). Receptacle contact sections (8*a*) of receptacle contacts (8) in connector member (2) have low-pressure contact members (22) in electrical engagement with outer ends (13) of tab contact sections (7*b*) of tab contacts (7) in connector member (1) when the circuit board (11*a*, 11*b*) are parallel to one another (FIG. 7A). High-pressure contact members (23) of the receptacle contact sections (8*a*) are in electrical engagement with inner sections (13') of the tab contact sections (7*b*) when the circuit boards (11*a*, 11*b*) are at a right angle with respect to one another (FIG. 7C).

9 Claims, 4 Drawing Sheets

HINGED ELECTRICAL CONNECTOR

FIELD OF THE INVENTION

This invention relates to a hinged electrical connector for electrically connecting electronic circuits between circuit boards and to enable the circuit boards to be angularly moved and positioned relative to one another.

BACKGROUND OF THE INVENTION

A hinged electrical connector is disclosed in U.S. Pat. No. 4,632,475. The male or tab contact sections of electrical contacts in a first dielectric housing are electrically engaged by female or receptacle contact sections of electrical contacts in a second dielectric housing. The second dielectric housing is pivotally mounted to the first housing so that the housings can be moved relative to one another when the electrical contacts are electrically connected to respective circuit boards, thereby enabling the circuit boards to be angularly positioned relative to each other. Each tab contact section has a uniform width therealong with a radiused front end which enables the tab contact section to be positioned within a respective parallel spaced plate of the receptacle contact section. The positioning of the tab contact sections within the receptacle contact sections is difficult because the area of contact between these contact sections is quite large, as is the coefficient of friction therebetween, especially when a large number of contacts are involved. Moreover, the pivotal movement of the contact sections is hampered as a result of the large area of contact and the large coefficient of friction between the sections. If the coefficient of friction is reduced by decreasing the forces of engagement of the receptacle contact sections onto the tab contact sections, this will enable the tab contact sections to be more easily positioned and move with respect to the receptacle contact sections. However, the electrical resistance between the contact sections will be increased resulting in corrosion problems which are undesirable for electronic circuits. Such an arrangement is therefore undesirable.

Another hinged electrical connector is disclosed in U.S. Pat. No. 4,657,320 wherein the recesses of the dielectric housing in which the receptacle contact sections are disposed are appropriately dimensioned so as to bias the receptacle contact sections into engagement with the tab contact sections thereby increasing the coefficient of friction therebetween making it difficult to position the tab contact sections within the receptacle contact sections and to pivotally move the contact sections relative to each other.

The objective of the present invention is to provide a hinged electrical connector that overcomes the problems of the above-described hinged electrical connectors. Other objectives are to reduce the contact pressure applied by the receptacle contact sections on the tab contact sections during insertion and removal therefrom, maintain a high degree of reliability during use and meet the needs of increasing density of components on the circuit boards.

SUMMARY OF THE INVENTION

According to the present invention, a hinged electrical connector for electrical connection to the conductive areas of separate circuit boards to interconnect the electronic circuits thereof and to enable the circuit boards to be angularly moved relative to each other comprises a first connector member and a second connector member having pivot means pivotally mounting the connector members together, thereby enabling the connector members to be angularly movable relative to each other and tab electrical contacts in the first connector member are electrically and movably disposed in receptacle electrical contacts in the second connector member. Tab contact sections of the tab contacts have outer segments in electrical engagement between first opposed contact members of receptacle contact sections of the receptacle contacts when the connector members are at a first position and the tab contact sections have inner segments in electrical engagement between second opposed contact members of the receptacle contact sections when the connector members are at a second position.

The receptacle contact sections have low-pressure and high-pressure contact members. The low-pressure contact members enable outer segments of the tab contact sections to be inserted into the receptacle contact sections with a low insertion force when the connector members are being hinged together and they apply low contact pressure on the outer ends of the tab contact sections when the connector members are in a first position. The high-pressure contact members electrically engage the inner sections of the tab contact sections and apply high contact pressure on the inner parts of the tab contact sections when the connector members are in a second position with the low-pressure contact members still electrically engaging the outer segments of the tab contact sections.

BRIEF DESCRIPTION OF THE DRAWINGS

The invention, together with the objects and advantages, is described by way of example with reference to the following detailed description in conjunction with the accompanying drawings.

DETAILED DESCRIPTION OF THE INVENTION

Figure 1:
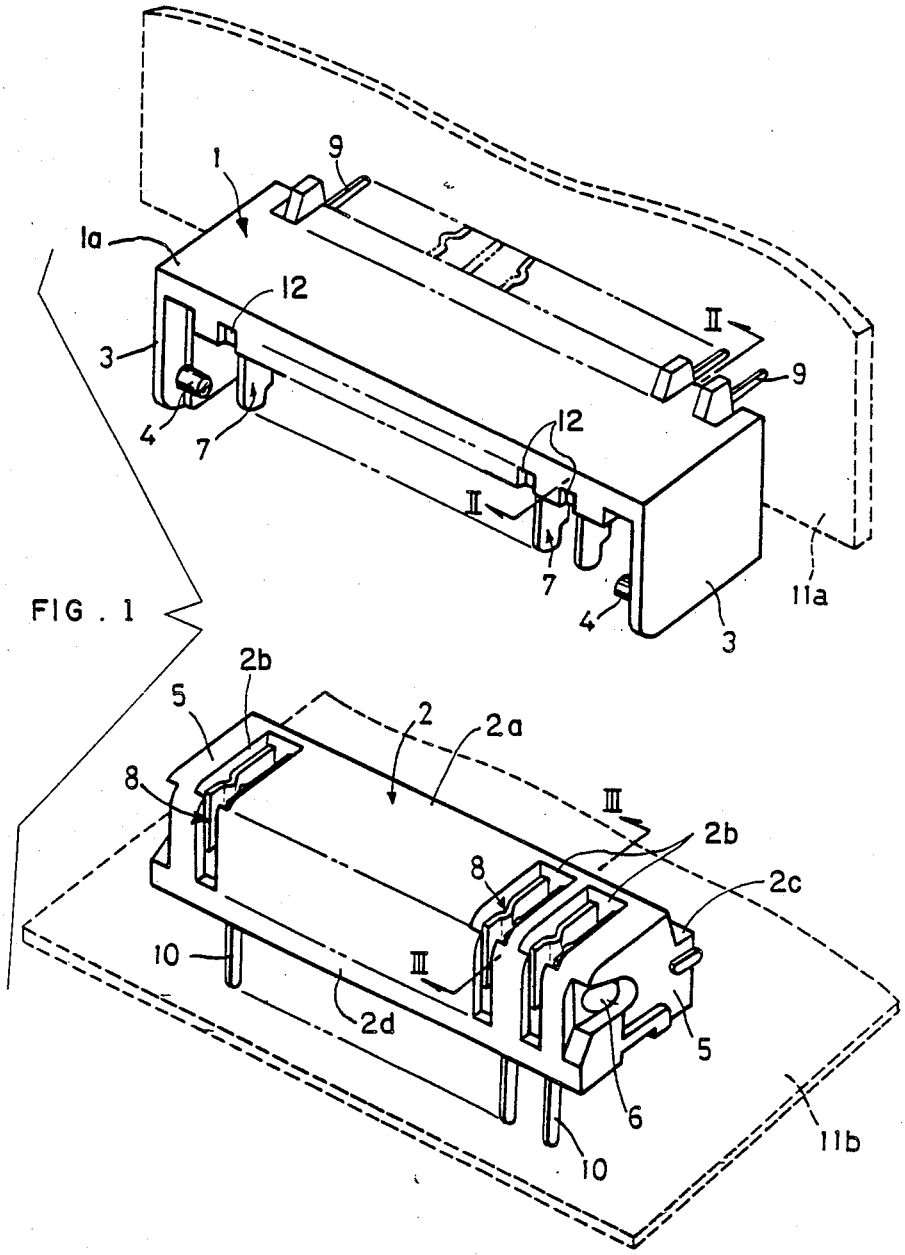
FIG. 1 is a perspective and exploded view of electrical connector members of a hinged electrical connector prior to being hingedly connected together to interconnect circuit boards.
Figure 7A:
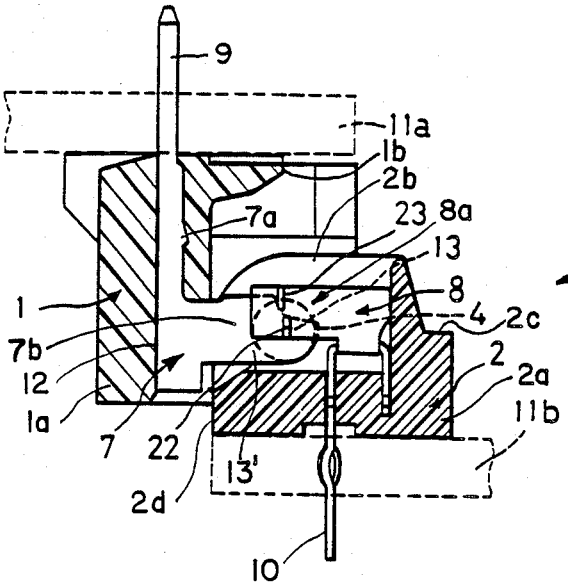
FIGS. 7A–C are cross-sectional views of the hinged connector showing first, intermediate and second positions of the connector members.
Figure 7B:
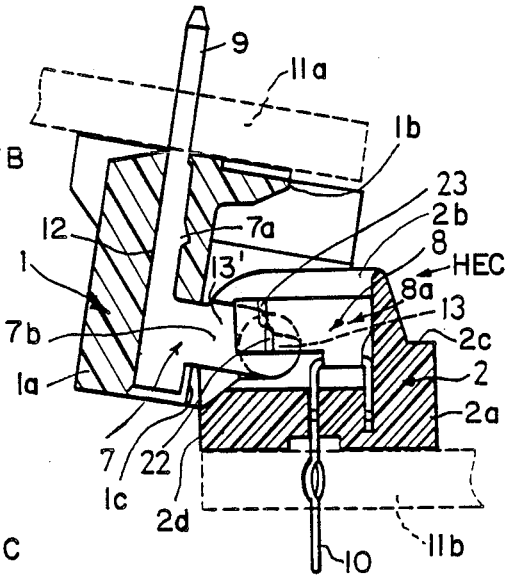
Figure 7C:
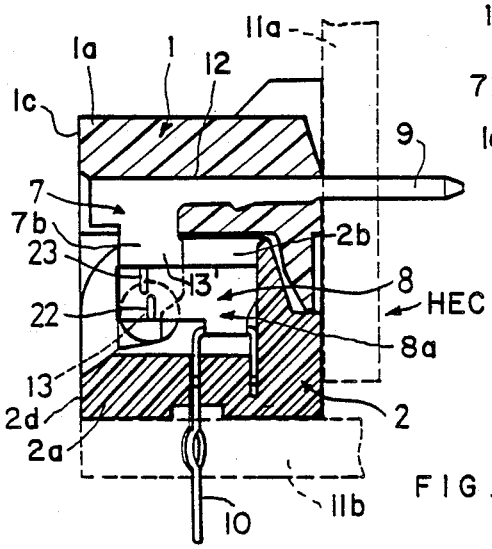

As shown in FIG. 1, electrical tab connector member 1 and electrical receptacle connector 2 are shown prior to being hingedly connected together to form a hinged electrical connector HEC as shown in FIGS. 7A–C. Connector members 1, 2 are hingedly coupled together by short shafts 4 extending inwardly from inside surfaces of side walls 3 of dielectric housing 1*a*. Shafts 4 are disposed in recesses 6 in outside surfaces of side walls 5 of dielectric housing 2a. This enables connector members 1, 2 to be angularly movable relative to one another.

Electrical tab contacts 7 are secured in spaced slots 12 of housing 1a by barbs 7a. Electrical receptacle contacts 8, corresponding to the same number of tab contacts 7, have receptacle contact sections 8a disposed in spaced slots 2b of housing 2a and posts 10 extend through holes 19 and outwardly from housing 2a while legs 18 are pressed-fitted into holes 20 of housing 2a thereby securing receptacle contacts 8 therein. Posts 9 of tab contacts 7 extend outwardly from housing 1a. Thus, posts 9, 10 are disposed in holes of circuit boards 11a, 11b and electrically connected to respective conductive paths thereof. Mounting members (not shown) are provided on connector members 1, 2 to mount them on boards 11a, 11b before posts 9, 10 are soldered to the conductive paths.

Figure 2:
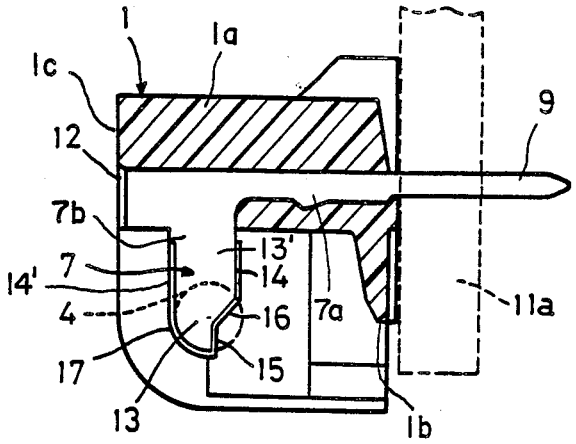
FIG. 2 is a cross sectional view taken along line II—II of the tab connector member of FIG. 1.
Figure 3:
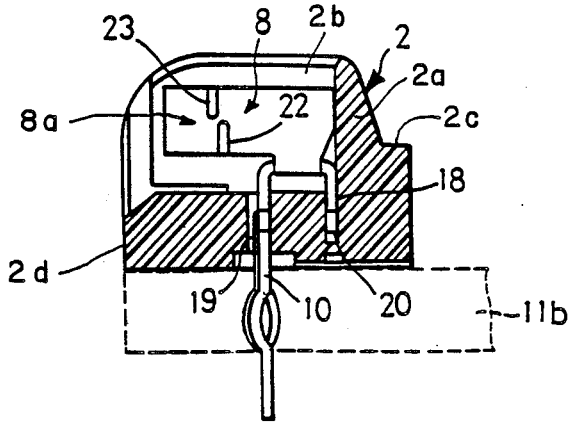
FIG. 3 is a cross-sectional view taken along line III—III of the receptacle connector member of FIG. 1.

FIG. 2 more clearly shows the tab contact section 7b of the tab contact 7 which is in the form of a plate. The outer end 13 of tab contact section 7b has a straight surface 15, a tapered surface 16 and a radiussed surface 17. The inner section or part 13' of the tab contact section 7b has parallel surfaces 14, 14' with surface 14 connecting with surface 16 and being parallel with surface 15. Surfaces 14, 14', 15, 16 and 17 are edges of the tab contact section 7b and they are beveled therealong on both sides (FIG. 2). The area of outer end 13 is less than the area of inner section 13'.

Figure 4:
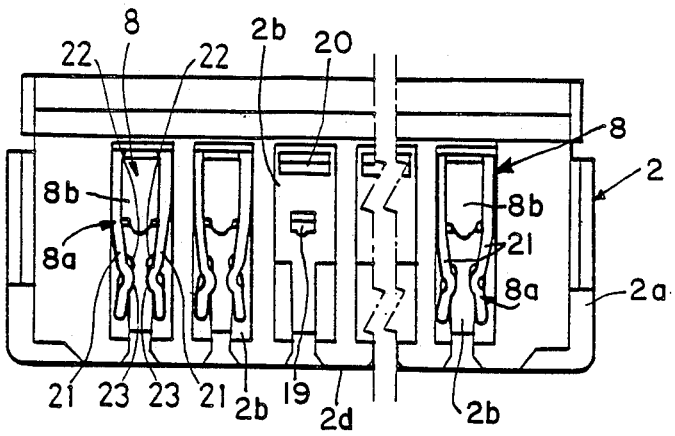
FIG. 4 is a top plan view of the receptacle connector member.
Figure 5:
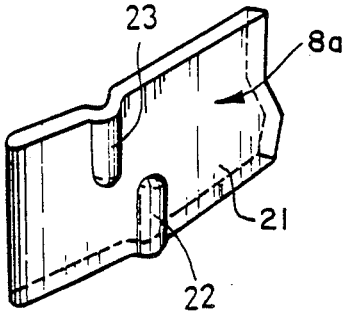
FIG. 5 is a part perspective view of a plate of the receptacle contact section showing the low and high pressure contact members.
Figure 6:
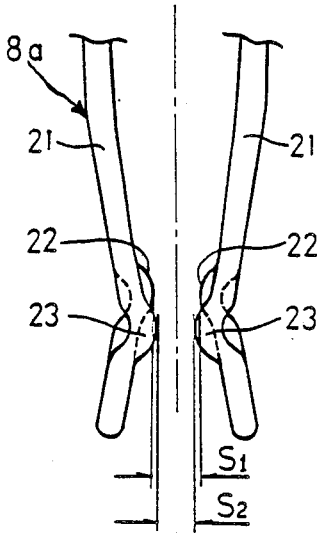
FIG. 6 is a top plan view showing part of the plates of the receptacle contact section and the spacing of the low and high pressure contact members.

FIGS. 3–6 more clearly show the receptacle contact section 8a of the receptacle contact 8 and it includes spaced opposed plates 21 that are connected at their bottom ends to section 8b (FIG. 4). Plates 21 are parallel at their inner ends from post 10 to leg 18; from post 10 they taper toward one another to low pressure contact members 22 and high pressure contact members 23; and, from the contact members 22, 23, plates 21 taper outwardly as best shown in FIG. 6. Contact members 22 are positioned opposite each other in a lower part of plates 21 and they are spaced slightly inwardly from contact members 23 which are also opposite each other in an upper part of plates 21. Contact members 22, 23 are elongate, inwardly-directed, arcuate projections and their inner ends are located at a center of plates 21.

A shown in FIG. 6, the spacing $S_1$, between contact members 22 is greater than the spacing $S_2$ between contact members 23. Thus, contact members 22 are low-pressure contact members whereas contact members 23 are high-pressure contact members.

FIG. 7A shows the position of connector members 1, 2 when they have been hingedly and electrically connected together with short shafts 4 positioned in recesses 6 and outer ends 13 of tab contact sections 7a disposed between plates 21 of the receptacle contact sections 8a in electrical engagement between only the low-pressure contact members 22. Thus, prior to the connector members 1, 2 being hingedly and electrically connected together, they are positioned as shown in FIG. 7A but spaced from each other; they are then connected together as described above with circuit boards 11a, 11b parallel to one another. The fact that outer ends 13 of tab contact sections 7b are only connected with low-pressure contact members 22 when connector members 1, 2 are hingedly connected together results in a low insertion force making it easier to insert outer ends 13 between the low-pressure contact members 22 and to hingedly and electrically connect the connector members 1, 2 together. In this position (FIG. 7A), inner sections 13' of tab contact sections 7b are not positioned between high-pressure contact members 23, but tapered surfaces 16 can be in engagement with contact members 23; and contact members 22 are located within the circumference of shafts 4. Surface 1c of housing 1a engages surface 2d of housing 2a to maintain boards 11a, 11b parallel to each other.

As shown in FIG. 7B, board 11a and connector member 1 are moved clockwise relative to board 11b and connector member 2 via shafts 4 which causes the tapered surfaces 16 to cam contact members 23 outwardly so that inner sections 13' of tab contact sections 7b can be electrically engaged by high-pressure contact members 23 during the clockwise movement of outer sections 13' relative to contact members 23 until surface 1b of housing 1a engages surface 2c of housing 2a when the connector members 1,2 reach ninety degrees as shown in FIG. 7C. Thus, contact members 23 electrically engage inner sections 13' of tab contact sections 7b from about ten degrees to ninety degrees. The contact pressure of high-pressure contact members 23 on tab contact sections 7b is therefore increased resulting in a high degree of contact reliability therebetween. Contact members 22 are always in engagement with outer ends 13 of the tab contact sections 7b. If it is desired to disconnect connector members 1, 2, they are positioned as in FIG. 7A because of the low-pressure contact members 22 on outer ends 13 of tab contact sections 7b thereby making it less difficult to remove the tab contact sectons 7b from the the receptacle contact sections 8a. The movement of tab contact sections 7b along contact members 22, 23 also cleans the surfaces therebetween resulting in a much better electrical connection.

As disclosed, a hinged electrical connector comprises electrical connector members hingedly connected together by shafts of one connector member disposed in recesses in the other connector member and tab contact sections of electrical tab contacts of the14ne connector member electrically are engaged within receptacle contact sections of electrical receptacle contacts of the other connector member. Posts of the tab contacts and the receptacle contacts are electrically connected to respective circuit boards so that the circuit boards are parallel or in one position relative to each other when the one connector member is hingedly connected to the other connector member and the outer ends of the tab contact sections are electrically engaged between low-pressure contact members of the receptacle contact sections. The circuit boards and connector members thereon are movable relative to one another so that the circuit boards are at a right angle or a second position and inner sections of the tab contact sections are electrically engaged between high-pressure contact members of the receptacle contact sections.

We claim:

1. A hinged electrical connector comprising first and second connector members having first and second dielectric housings, electrical tab contacts secured in the first housing and electrical receptacle contacts secured in the second housing, the tab contacts and the receptacle contacts having termination sections for electrical connection to circuit boards, shafts of one connector member being disposed within recesses of the other connector member for hingedly mounting the one connector member to the other connector member and tab contact sections of the tab contacts being electrically engaged between receptacle contact sections of the receptacle contacts, characterized in that the receptacle contact sections have low-pressure contact members and high-pressure contact members, the high-pressure contact members being spaced apart a distance which is less than the spacing between the low-pressure contact members, said tab contact sections having outer ends which are electrically engaged between the low-pressure contact members of the receptacle contact sections when the circuit boards are at a first position relative to one another and the tab contact sections have inner sections which are electrically engaged between the high-pressure contact members of the receptacle contact sections when the circuit boards are at a second position relative to one another.

2. A hinged electrical connector as claimed in claim 1, characterized in that each said outer end of the tab contact sections has a tapered surface connected between outer and inner parallel surfaces and a radiussed surface connected between the inner parallel surface and another surface parallel to the outer surface.

3. A hinged electrical connector as claimed in claim 1, characterized in that the receptacle contact sections are spaced opposed plates and the contact members are elongated inwardly-directed arcuate projections adjacent front ends of the plates.

4. A hinged electrical connector as claimed in claim 3, characterized in that the high-pressure contact members are located in the upper part of the plates and the low-pressure contact members are located in the lower part of the plates.

5. A hinged electrical connector as claimed in claim 4, characterized in that the low-pressure contact members are located inwardly from the high-pressure contact members.

6. A hinged electrical connector as claimed in claim 5, characterized in that the inner ends of the contact members are located at the center of the plates.

7. A hinged electrical connector as claimed in claim 3, characterized in that the plates have rear parallel sections, intermediately inwardly-tapered sections and forward outwardly-tapered sections with the low-pressure contact members being located on the inwardly-tapered sections and the high-pressure contact sections being located at the junction of the inwardly-tapered and outwardly-tapered sections.

8. A hinged electrical connector as claimed in claim 1, characterized in that the housings have surfaces that engage each other to position the boards at the second position.

9. A hinged electrical connector as claimed in claim 1, characterized in that the housings have surfaces that engage each other to position the boards at the first position.

* * * * *

UNITED STATES PATENT OFFICE

CERTIFICATE OF CORRECTION

Patent No. 4,877,409 Dated October 31, 1989

Inventor(s) Junichi Tanigawa, Shoji Kikuchi

It is certified that error appears in the above-identified patent and that said Letters Patent is hereby corrected as shown below:

In the Abstract:

Line 2, the second "11a" should be --11b--.

Signed and Sealed this

Fifteenth Day of January, 1991

*Attest:*

HARRY F. MANBECK, JR.

*Attesting Officer*

*Commissioner of Patents and Trademarks*